US011234882B2

(12) United States Patent
Obert et al.

(10) Patent No.: US 11,234,882 B2
(45) Date of Patent: Feb. 1, 2022

(54) OPERATIONAL TABLE PEDESTAL WITH STABILIZING GUIDE

(71) Applicant: MAQUET GMBH, Rastatt (DE)

(72) Inventors: Mike Obert, Gernsbach (DE); Jan Donat Olszewski, Rastatt (DE)

(73) Assignee: MAQUET GMBH, Rastatt (DE)

( * ) Notice: Subject to any disclaimer, the term of this patent is extended or adjusted under 35 U.S.C. 154(b) by 77 days.

(21) Appl. No.: 16/450,308

(22) Filed: Jun. 24, 2019

(65) Prior Publication Data

US 2019/0307625 A1 Oct. 10, 2019

Related U.S. Application Data

(63) Continuation of application No. PCT/EP2017/084720, filed on Dec. 28, 2017.

(30) Foreign Application Priority Data

Dec. 28, 2016 (DE) ..... 10 2016 125 800.8

(51) Int. Cl.
*A61G 13/06* (2006.01)
*A61G 13/10* (2006.01)

(52) U.S. Cl.
CPC ..... *A61G 13/06* (2013.01); *A61G 13/10* (2013.01)

(58) Field of Classification Search
CPC ..... A61G 13/02; A61G 13/04; A61G 13/06; A61G 13/10
See application file for complete search history.

(56) References Cited

U.S. PATENT DOCUMENTS 1,346,586 A * 7/1920 Barber ..... A61G 13/06 248/404
4,944,500 A * 7/1990 Mueller ..... A61G 13/10 5/600

(Continued)

FOREIGN PATENT DOCUMENTS

DE 2715061 A1 10/1978
DE 4423402 A1 1/1996

(Continued)

OTHER PUBLICATIONS

International Search Report dated Mar. 14, 2018 during the prosecution of corresponding International Patent Application No. PCT/EP2017/084720, 2 pages.

(Continued)

*Primary Examiner* — David R Hare
*Assistant Examiner* — Alexis Felix Lopez

(57) ABSTRACT

A table pedestal for an operating table, comprising a pedestal base for connecting the table pedestal to the floor; a pedestal head support that is adjustable in height for supporting the head of the pedestal; a lifting drive for adjusting the height of the pedestal head support in relation to the base of the pedestal; a cylindrical main guide connecting the pedestal head support to the pedestal base, and serving to provide a vertical guide of the pedestal head support in its height adjustment. An additional stabilizing guide, which also connects the pedestal head support to the pedestal base and provides a vertical guide for the pedestal head support in its height adjustment, reduces the play in rotation of the main guide.

19 Claims, 5 Drawing Sheets

(56) References Cited

U.S. PATENT DOCUMENTS 5,528,782 A * 6/1996 Pfeuffer ..... A61G 13/02 108/147
5,621,933 A * 4/1997 Knapp ..... A61G 7/018 5/607
6,681,423 B2 * 1/2004 Zachrisson ..... A61G 13/04 5/601
6,886,200 B2 * 5/2005 Blyshak ..... A61G 13/02 254/93 R
7,125,167 B2 * 10/2006 Alakkat ..... A61B 6/04 378/209
7,530,542 B2 * 5/2009 Boyce ..... B60R 11/02 108/4
7,588,232 B2 * 9/2009 Wei ..... F16H 19/0663 211/117
2004/0098804 A1 * 5/2004 Varadharajulu ..... A61G 13/04 5/611
2007/0043309 A1 * 2/2007 Luetke-Wenning ..... A61H 23/0254 601/86
2010/0187379 A1 * 7/2010 Kragh ..... A47B 9/12 248/188.4
2013/0254992 A1 * 10/2013 Jackson ..... A61G 13/06 5/607
2015/0000038 A1 * 1/2015 Obi ..... A61G 13/02 5/601
2016/0000620 A1 * 1/2016 Koch ..... A61G 7/008 5/608
2016/0331613 A1 * 11/2016 Lee ..... A61G 13/06

FOREIGN PATENT DOCUMENTS

DE 102014109377 A1 1/2016
JP S55-70127 10/1986
JP H04-96781 3/1992
JP 2014-039593 A 3/2014

OTHER PUBLICATIONS

Notification of Reasons for Refusal dated Aug. 31, 2021 during the prosecution of corresponding Japanese Patent Application No. 2019-533499, 3 pages.

* cited by examiner

Prior Art

Prior Art

V - V

OPERATIONAL TABLE PEDESTAL WITH STABILIZING GUIDE

RELATED CASES

Benefit and priority is claimed with regard to: PCT/EP2017/084720, filed Dec. 28, 2017, and DE 10 2016 125 800.8, filed Dec. 28, 2016. Both are incorporated herein.

BACKGROUND OF THE DISCLOSURE

The present disclosure relates to a table pedestal for an operating table, to stabilizing guides for use therewith, and to medical and surgical tables.

Such a table pedestal is known from the document DE 10 2014 109 377 A1 (E1), which originated from the parent company of the present applicant. The operating table pedestal described in this document has a pivotable perforated disk 36, by means of which adjusting movements are possible between the secondary guide 34*a* and the main guide 32 (see FIG. 5*b* and § 54). The disk 36 is connected to the chassis 38.

One disadvantage here is that the entire secondary guide 34*a* is moved in relation to the main guide 32 in an adjusting movement. Furthermore, the adjusting movement takes place only within a predetermined plane (see FIG. 5*b*).

Another known table pedestal is illustrated in the accompanying FIGS. 1 and 2. The table pedestal 2 comprises a pedestal base 4, a pedestal head support 6 that is adjustable in height, a lift drive 7 and a cylindrical main guide 10.

The table pedestal 2 can be attached to the bottom of an operating room by means of its base 4 in a known way. Alternatively, the table pedestal may also be movable on the floor. The upper add-on structures of the table pedestal (not shown) are attached to the pedestal head support 6.

To adjust the height, the pedestal head support 6 can be moved up and down in relation to the column base 4. This is accomplished by operating the lift drive 7.

The cylindrical main guide 10 is provided for controlled adjustment of height. In the example shown here, it is a telescopic guide. An outer telescopic cylinder 11 and an inner telescopic cylinder 12 can be retracted and extracted again here in a common guide base. To prevent twisting about a vertical axis Z-Z of the telescopic cylinders 11, 12 in relation to one another and with respect to the guide base 14, each telescopic cylinder 11, 12 therefore has longitudinal grooves 16, which cooperate with fitting keys 18.

The enlarged diagram in FIG. 2 shows a longitudinal groove 16 of the outer telescopic cylinder 11 in greater detail. A fitting key 18 in the guide base 14 is accommodated in the longitudinal groove 16. This guides the outer telescopic cylinder 11 in a vertical up-and-down movement (see arrow F1). At the same time, the outer telescopic cylinder 11 is prevented from twisting around the vertical axis Z-Z (see double arrow F2).

However, a slight play remains in the direction of rotation F2, as indicated by the angle a in FIG. 2. For better illustration, the angle a is shown in greatly exaggerated form. The fitting key 18 is arranged close to the axis of rotation Z-Z. However, one end of the patient supporting surface connected to the table pedestal 2 is 1 to 2 meters away from the axis of rotation Z-Z. Accordingly, a slight rotational play by angle a indicates a significant rotational play at the end of the patient supporting surface, which may amount to a few millimeters. Such play results in a slight wobbling of the patient supporting surface. However, such a slight instability of the patient supporting surface can cause problems in some operations on patients.

Another known table pedestal is described in the document DE 44 23 402 A1.

The documents DE 2 715 061 A1 and JP 2014-039593 A also relate to known lifting devices for dental chairs.

SUMMARY OF THE DISCLOSURE

One object of the present disclosure is to provide a table pedestal having a particularly great rigidity to prevent twisting about the vertical axis Z-Z.

Another object of the disclosure is to make available a table pedestal that is better and simpler from the standpoint of construction technology to prevent the stabilizing guide from seizing.

By providing an additional stabilizing guide, the column head support is guided along the vertical axis in a second location. This prevents even minor twisting of the telescopic cylinders. In the case of preferred exemplary operating table pedestals according to the present disclosure, fewer building parts are involved in the adjusting movement than is the case with the table pedestal known from document E1.

Furthermore, the stabilizing guide may be prevented from seizing thanks to up to three degrees of freedom in rotation and one degree of freedom in translation.

Embodiments may include a table pedestal for an operating table, the table pedestal comprising some or all of the following features:

- a pedestal base for supporting the table pedestal;
- a pedestal head support that is adjustable in height for supporting the head of the pedestal;
- a lifting drive for adjusting the height of the pedestal head support in relation to the base of the pedestal;
- a main guide connecting the pedestal head support to the pedestal base and serving to provide a vertical guide of the pedestal head support in its height adjustment, where the main guide may optionally be cylindrical and/or telescoping; and
- a stabilizing guide, which connects the pedestal head support to the pedestal base and serves to provide a vertical guide for the pedestal head support in its height adjustment, while also reducing the play in rotation of the main guide,
- the stabilizing guide may be coupled mechanically to the pedestal head support by means of a coupling device, wherein the coupling device allows adjusting movements between the cylindrical main guide and the stabilizing guide to prevent the stabilizing guide from seizing, and
- the coupling device may have a plurality of components, the adjusting movements made possible by pivotability of a first coupling component relative to a second coupling component about at least one axis of rotation, or about three different axes of rotation, and also due to displaceability of the first coupling component relative to the second coupling component along an axis of translation.

In some embodiments the coupling device comprises a pendulum ball bearing or a ball joint. These enable adjustment movements between the main guide and the stabilizing guide to prevent the stabilizing guide from seizing.

The coupling device may include a bearing journal by means of which the pendulum ball bearing is displaceably mounted.

In some embodiments the stabilizing guide comprises a guide rail mounted on the pedestal base and a guide carriage that is mounted on the pedestal head support and is guided on the guide rail. The guide carriage may be mounted on the pedestal head support by means of the coupling device. The guide carriage may be mounted on the pedestal head support by means of the bearing journals of the coupling device arranged thereon. The longitudinal axis of the guide rail may run in a vertical direction. The rail web of the guide rail may extend in a radial direction starting from a rail base to a rail head with respect to the cylindrical main guide.

In some embodiments the stabilizing guide is mounted on the periphery of the column head support. In some embodiments the main guide is a telescopic guide and/or cylindrical. Telescopic guides may have a plurality of telescoping segments. A telescopic guide can optionally have at least one telescopic cylinder which is rotationally secured by means of a fitting key that engages in a longitudinal groove of another telescopic cylinder to prevent it from twisting about a vertical axis.

Embodiments in some cases are a complete medical table, the medical table comprising: a table pedestal and a patient support surface, wherein the patient support surface is height adjustable by a lifting drive.

In some embodiments the coupling device has a plurality of components, and adjusting movements are made possible by pivotability of a first coupling component relative to a second coupling component about one or more axes of rotation, and/or due to displaceability of the first coupling component relative to the second coupling component along an axis of translation.

BRIEF DESCRIPTION OF THE DRAWINGS

A preferred exemplary embodiment of the disclosure will now be explained in greater detail with reference to the drawings, in which.

DETAILED DESCRIPTION OF THE FIGURES

Figure 3:
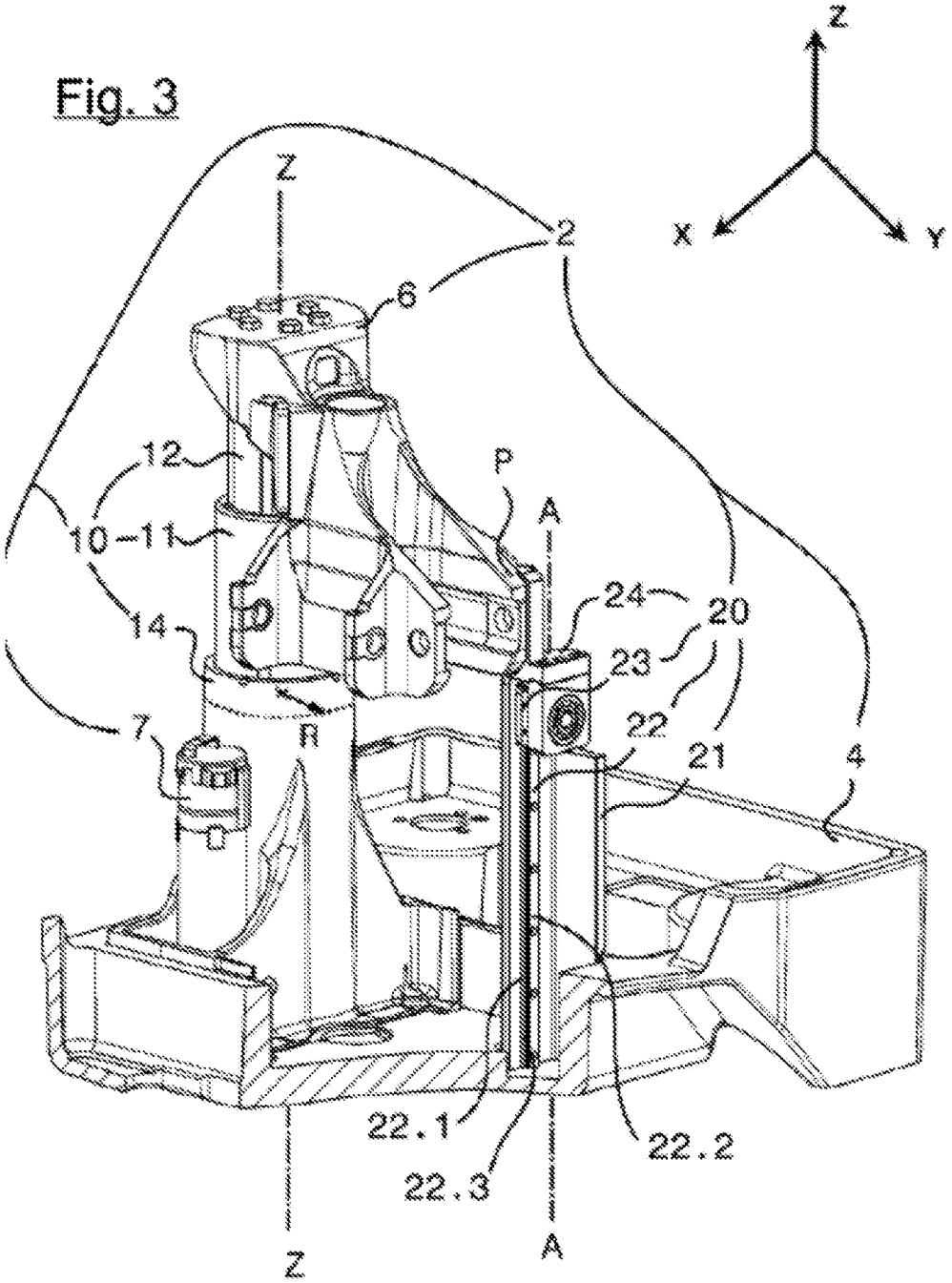
FIG. 3 shows a perspective view of an exemplary operating table pedestal according to the disclosure.

FIG. 3 shows parts of an operating table pedestal 2 according to the disclosure. The parts shown here include a pedestal base 4, a lifting drive 7, a pedestal head support 6, a cylindrical main guide 10 and a stabilizing guide 20 according to the present disclosure.

For better illustration, a Cartesian coordinate system X-Y-Z is shown. The Z axis is the vertical axis, the X axis is the horizontal longitudinal axis, and the Y axis is the horizontal transverse axis. The axis of rotation Z-Z of the telescopic cylinders 11 and 12 runs vertically. The direction along the axis of rotation Z-Z is referred to below as the axial direction, the direction along the circumference of the telescopic cylinders is referred to as the circumferential direction, and the direction along a radius of the telescopic cylinders 11, 12 is referred to as the radial direction R (see the arrow in FIG. 3).

Figure 1:
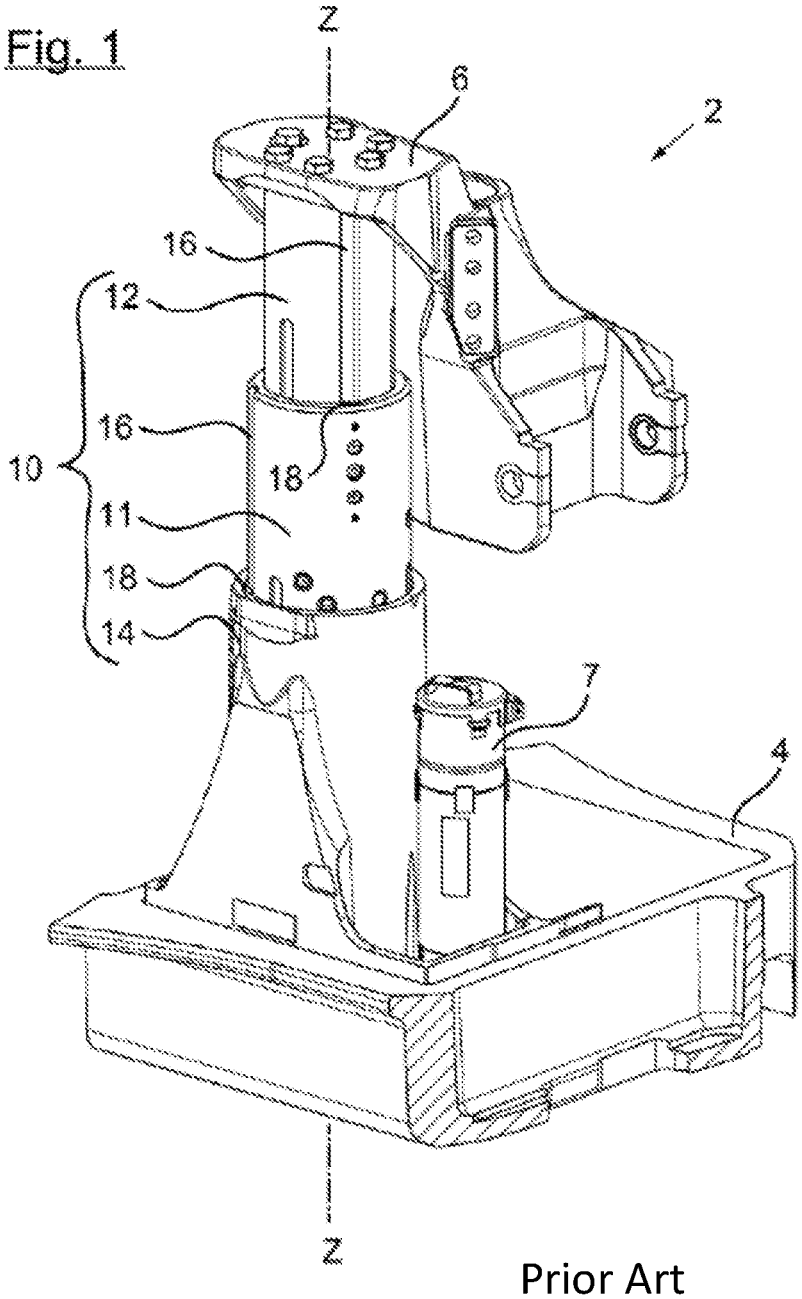
FIG. 1 shows a perspective view of a known operating table pedestal.
Figure 2:
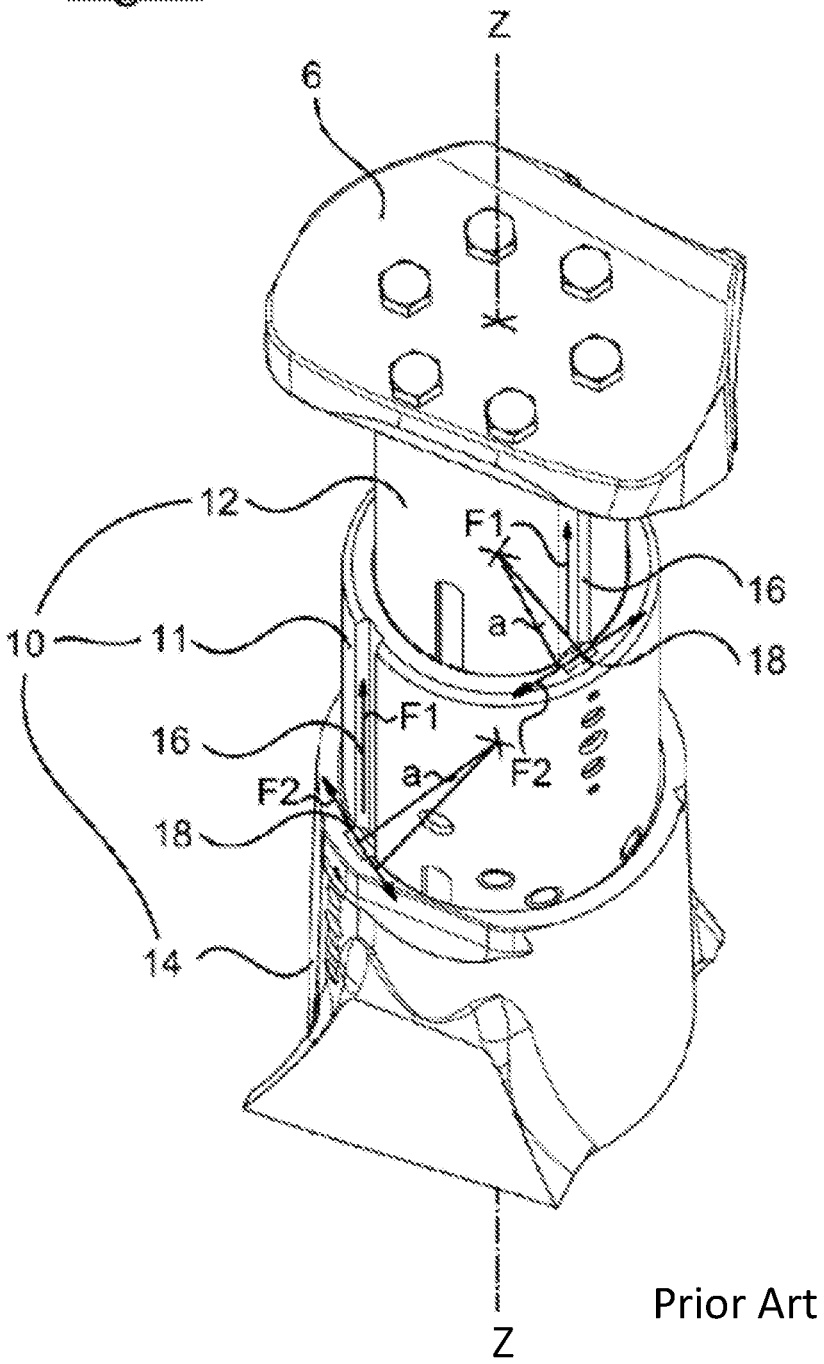
FIG. 2 shows a detailed perspective view of the telescopic guide of the operating table pedestal of FIG. 1.

The column base 4, the pedestal head support 6, the lifting drive 7 and the main guide 10 are identical to the corresponding parts shown in FIGS. 1 and 2 and therefore will not described again.

The stabilizing guide 20 extends in the vertical direction Z along the longitudinal axis A-A. This is roller body circumferential linear guide, preferably in a prestressed embodiment without play. Alternatively, the roller body circumferential linear guide may also be replaced by a suitable sliding guide, for example, a dovetail guide, which can be adjusted without play. The stabilizing guide 20 comprises a mounting bracket 21, a guide rail 22 arranged on the mounting bracket 21, a guide carriage 23 guided on the guide rail 22 and a coupling device 24.

Figure 4:
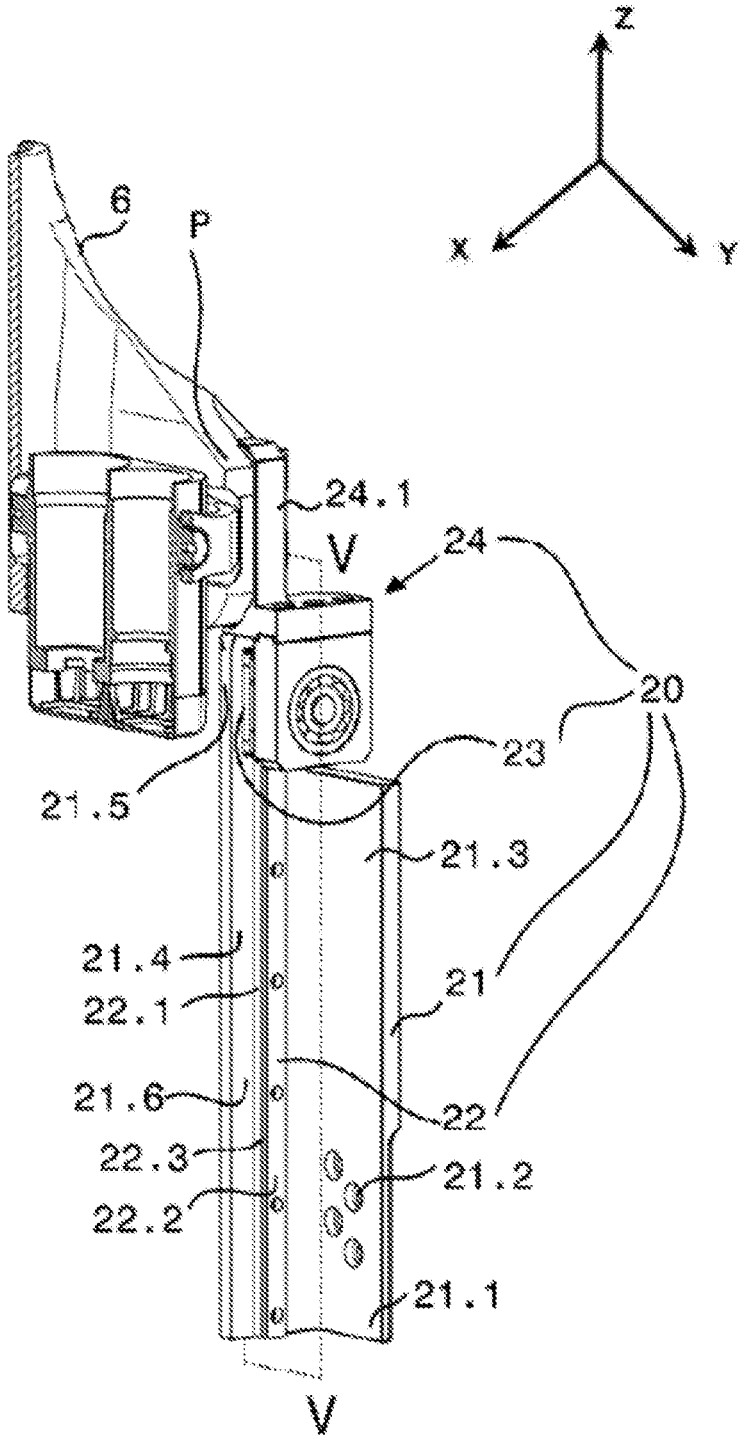
FIG. 4 shows a perspective view of the stabilizing guide of the operating table pedestal from FIG. 3.

As can be seen in FIG. 4, the mounting bracket 21 has a mounting side 21.3 and a guide side 21.4. The mounting side 21.3 and the guide side 21.4 are arranged at an angle to one another. The guide side 21.4 extends upward with an upper side end 21.5 beyond the mounting side 21.3. The mounting side 21.3 is thus shortened in comparison with the guide side 21.4 in order to avoid a collision with the parts of the operating table that are not shown in moving the table pedestal 2. The stabilizing guide 20 is secured on the pedestal base 4 by a lower side end 21.1 of the mounting side 21.3. To be more precise, the lower side end 21.1 has holes 21.2 (see FIG. 4), by means of which the mounting bracket 21 can be bolted to the pedestal base 4. The mounting bracket 21 is designed to have the greatest possible rigidity, so it is designed to be as sturdy as possible in the available installation space. In one variant of a stabilizing guide 20 according to the present disclosure, the mounting bracket 21 can also be integrated into the guide base 14 or the pedestal base 4.

The guide rail 22 is mounted on an inside face 21.6 of the guide side 21.4. In doing so, the longitudinal axis of the guide rail runs in a vertical direction Z. The guide rail 22 extends into the upper side end 21.5. The guide rail 22 has a rail base 22.1, which sits on the inside face 21.6. The rail head 22.2 is a distance away from the inside face 21.6. The rail base 22.1 and the rail head 22.2 are connected to one another by a rail web 22.3. The rail web 22.3 extends to the rail head 22.2 in the radial direction R with respect to the cylindrical main guide 10 (see FIG. 3), starting from the rail base 22.1.

The arrangement of the mounting bracket 21 and the linear guide, as shown in the figures, was selected to achieve the best possible integration into the given installation space and good accessibility in assembly. The arrangement of a stabilizing guide 20 according to the present disclosure can of course also be varied.

The stabilizing guide 20 is mechanically coupled to the pedestal head support 6 by means of its coupling device 24. The coupling device 24 allows adjusting movements between the cylindrical main guide 10 and the stabilizing guide 20 to prevent the stabilizing guide from seizing.

Figure 5:
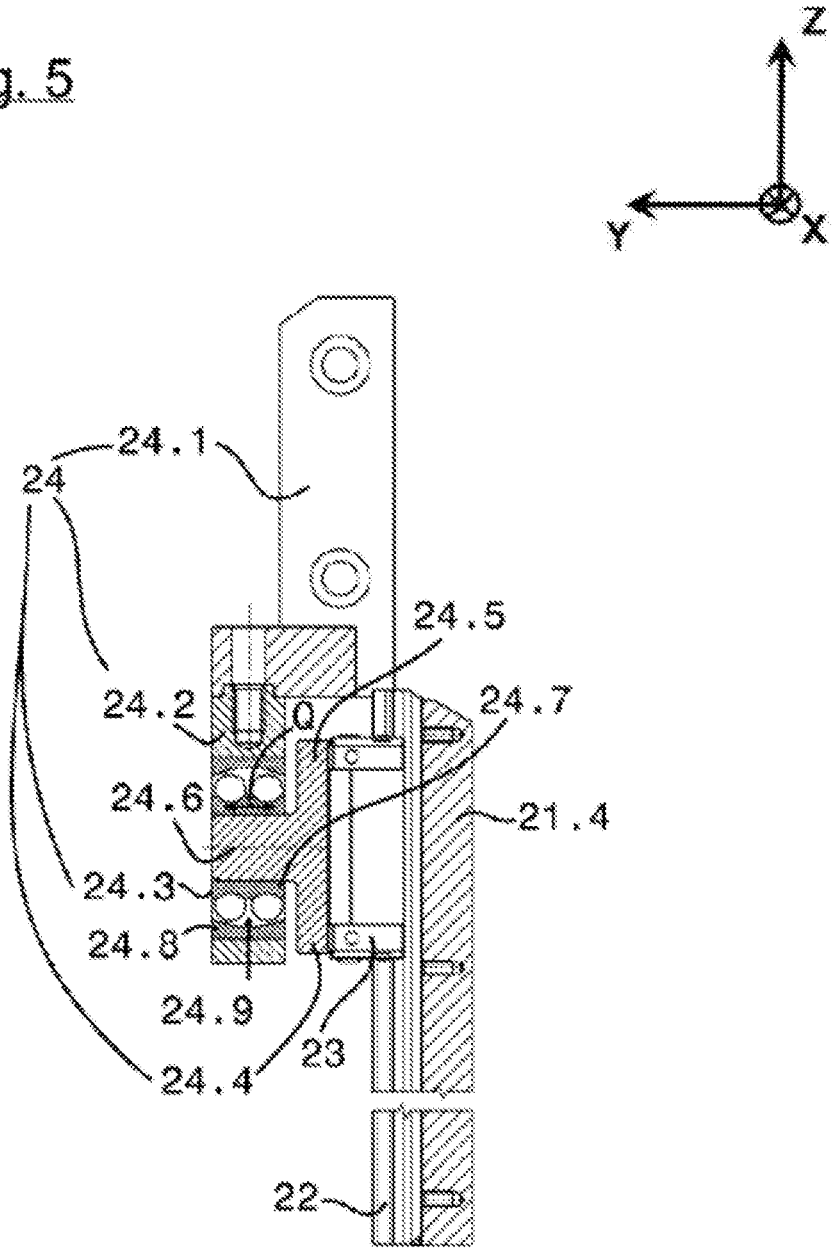
FIG. 5 shows a longitudinal section according to arrows V-V from FIG. 4 of the stabilizing guide according to the disclosure.

With respect to FIG. 5, the coupling device 24 comprises from top to bottom a bearing mount 24.1, a bearing housing 24.2 mounted on the bearing mount, a pendulum ball bearing 24.3 arranged in the bearing housing 24.2 and preferably used in a design that is prestressed without play as well as a bearing flange 24.4 mounted on the guide carriage 23. The bearing flange 24.4 has a base body 24.5 and a bearing journal 24.6 protruding away from the former. The pendulum ball bearing 24.3 is mounted to be displaceable about the bearing journal 24.6 and along an axis of translation Q (see double arrow).

The pendulum ball bearing 24.3 has an inner ring 24.7, an outer ring 24.8 and a pair of ball rows 24.9. The outer ring 24.8 can pivot about the three axes of rotation X, Y and Z relative to the inner ring 24.7. The outer ring 24.8 of the pendulum ball bearing 24.3 is pressed into the bearing housing 24.2 to be secured axially.

In variants of the disclosure, the pendulum ball bearing of the coupling device 24 can be replaced by a ball joint, or a friction bearing. Pendulum ball bearings, ball joints, and friction bearings may function as rotation means.

The stabilizing guide 20 can be mounted on the periphery P of the pedestal head support 6 by the bearing mount 24.1 (see FIG. 4).

The functioning of the stabilizing guide 20 according to this embodiment will now be explained. When the pedestal head support 6 is raised and lowered, it is guided vertically by the main guide 10 as well as by the stabilizing guide 20. The remaining twist play in the telescopic cylinders 11 and 12 as described in the introduction is neutralized by the additional stabilizing guide 20. At the same time the pendulum ball bearing 24.3 and its displaceable bearing on the bearing journal 24.6 ensure that there is no overdetermination. If the vertical alignment of the main guide 10 and that of the stabilizing guide 20 are not sufficiently parallel, it does not result in seizing of the guide carriage 23 on the guide rail 22, but instead the misalignment is compensated by pivoting of the outer ring 24.8 and the pendulum ball bearing 24.3 and/or displacement of the pendulum ball bearing 24.3 on the bearing journal 24.6. Thanks to the coupling device 24, the longitudinal axis A-A of the stabilizing guide 20 and the longitudinal axis Z-Z of the main guide 10 need not be exactly parallel. This simplifies the production and assembly of the operating table pedestal 2 according to the disclosure.

Due to the fact that the stabilizing guide 20 acts on the periphery P of the pedestal head support 6 at a sufficient distance from the axis of rotation Z-Z, a minimal play in the pendulum ball bearing 24.3 will not have any mentionable effect on the stability of the patient supporting surface mounted on the table pedestal.

The table pedestal according to the present disclosure is especially preferably used for an operating table equipped with surgical robot arms. With such a robot table, very special demands are made regarding the rigidity and stability of the table pedestal. The robot arms mounted on the operating table must rely on a table being particularly immovable, so that the patient can be operated on reliably and with high precision.

The present disclosure includes table pedestals comprising stabilizing guides; stabilizing guides; medical, dental, and surgical tables comprising stabilizing guides, pedestals, and patient support surfaces; robot surgery systems comprising table pedestals, stabilizing guides, patient support surfaces, and one or more robotic surgery arms. The present disclosure also includes methods of operating such devices.

The embodiments disclosed herein are non-limiting illustrative examples only. The various features disclosed can be used in different combinations, and with various table and pedestal arrangements.

The invention claimed is:

1. A table pedestal for an operating table, the table pedestal comprising:

a pedestal base for supporting the table pedestal;

a pedestal head support that is adjustable in height for supporting a head of the pedestal;

a lifting drive for adjusting the height of the pedestal head support in relation to the base of the pedestal;

a cylindrical main guide connecting the pedestal head support to the pedestal base and serving to provide a vertical guide of the pedestal head support in its height adjustment; and a stabilizing guide, which connects the pedestal head support to the pedestal base and serves to provide a vertical guide for the pedestal head support in its height adjustment, while also reducing the play in rotation of the main guide, wherein the stabilizing guide is coupled mechanically to the pedestal head support by means of a coupling device, wherein the coupling device allows adjusting movements between the cylindrical main guide and the stabilizing guide to prevent the stabilizing guide from seizing, wherein the coupling device comprises a first coupling component and a second coupling component, and the adjusting movements are made possible by pivotability of the first coupling component relative to the second coupling component about three different axes of rotation, and also due to displaceability of the first coupling component relative to the second coupling component along an axis of translation, and wherein the stabilizing guide comprises a guide rail mounted on the pedestal base and a guide carriage that is mounted on the pedestal head support and is guided on the guide rail.

2. The table pedestal according to claim according to claim 1, wherein the first coupling component comprises a pendulum ball bearing.

3. The table pedestal according to claim according to claim 2, wherein the second coupling component comprises a bearing journal by which the pendulum ball bearing is mounted displaceably.

4. The table pedestal according to claim 1, wherein the guide carriage is mounted on the pedestal head support by means of the coupling device.

5. The table pedestal according to claim 3, wherein the guide carriage is mounted on the pedestal head support by means of the bearing journals of the coupling device arranged thereon.

6. The table pedestal according to claim 1, wherein the longitudinal axis of the guide rail runs in a vertical direction.

7. The table pedestal according to claim 1, wherein a rail web of the guide rail extends in a radial direction starting from a rail base to a rail head with respect to the cylindrical main guide.

8. The table pedestal according to claim 1, wherein the stabilizing guide is mounted on a periphery of the pedestal head support.

9. The table pedestal according to claim 1, wherein the cylindrical main guide is a telescopic guide.

10. The table pedestal according to claim 9, wherein the telescopic guide has at least one telescopic cylinder, which is rotationally secured by means of a fitting key that engages in a longitudinal groove to prevent it from twisting about a vertical axis.

11. The table pedestal according to claim 1, wherein the coupling device comprises a ball joint which enables adjusting movements.

12. A medical table, the medical table comprising:

a table pedestal according to claim 1; and a patient support surface;

wherein the patient support surface is height adjustable by the lifting drive.

13. A table pedestal for an operating table, the table pedestal comprising:

a pedestal base for supporting the table pedestal;

a pedestal head support, the pedestal head support being height adjustable;

a lifting drive for adjusting the height of the pedestal head support in relation to the base of the pedestal;

a main guide connecting the pedestal head support to the pedestal base, the main guide comprising a plurality of telescoping sections and providing a vertical guide for the pedestal head support during height adjustment; and a stabilizing guide, the stabilizing guide connecting the pedestal head support to the pedestal base and providing a vertical guide for the pedestal head support during height adjustment, while also reducing the play in rotation of the main guide;

wherein the stabilizing guide is located laterally with respect to the main guide, and wherein the stabilizing guide and the main guide provide guidance along substantially parallel axes;

wherein the stabilizing guide is coupled to the pedestal head support through a coupling device, wherein the coupling device allows adjusting movements between the cylindrical main guide and the stabilizing guide to prevent the stabilizing guide from seizing;

wherein the coupling device comprises a first coupling component and a second coupling component, and the adjusting movements are made possible by pivotability of a first coupling component relative to a second coupling component, and also due to displaceability of the first coupling component relative to the second coupling component along an axis of translation;

wherein the stabilizing guide comprises a guide rail, and a guide carriage which is slideable along the guide rail; and wherein the guide carriage is connected to the pedestal head support via the coupling device.

14. The table pedestal according to claim 13, wherein said first coupling component and said second coupling component are both part of at least one of a pendulum ball bearing and a ball joint.

15. A table pedestal for an operating table, the table pedestal comprising:

a pedestal base for supporting the table pedestal;

a pedestal head support, the pedestal head support being height adjustable;

a lifting drive for adjusting the height of the pedestal head support in relation to the base of the pedestal;

a main guide connecting the pedestal head support to the pedestal base, the main guide comprising a plurality of sections and providing a vertical guide for the pedestal head support during height adjustment; and a stabilizing guide, the stabilizing guide connecting the pedestal head support to the pedestal base and providing a vertical guide for the pedestal head support during height adjustment, while also reducing the play in rotation of the main guide, wherein the stabilizing guide is located laterally to the main guide, and wherein the stabilizing guide and the main guide provide guidance along substantially parallel axes;

wherein the stabilizing guide is coupled to the pedestal head support through a coupling device, wherein the coupling device allows adjusting movements between the cylindrical main guide and the stabilizing guide to prevent the stabilizing guide from seizing;

wherein the coupling device comprises a rotation means; and wherein the stabilizing guide comprises a guide rail, and a guide carriage which is slideable along the guide rail.

16. The table pedestal according to claim 15:

wherein the guide rail is mounted on the pedestal base; and wherein the guide carriage is connected to the pedestal head support and is movable along the guide rail.

17. The table pedestal according to claim 15:

wherein the coupling device comprises a bearing journal, and a pendulum ball bearing displaceably mounted on the bearing journal.

18. The table pedestal according to claim 15:

wherein the rotation means of the coupling device comprises a pendulum ball bearing and a ball joint.

19. A table pedestal for an operating table, the table pedestal comprising:

a pedestal base for supporting the table pedestal;

a pedestal head support that is adjustable in height for supporting the head of the pedestal;

a lifting drive for adjusting the height of the pedestal head support in relation to the base of the pedestal;

a cylindrical main guide connecting the pedestal head support to the pedestal base and serving to provide a vertical guide of the pedestal head support in its height adjustment; and a stabilizing guide, which connects the pedestal head support to the pedestal base and serves to provide a vertical guide for the pedestal head support in its height adjustment, while also reducing the play in rotation of the main guide, wherein the stabilizing guide is coupled mechanically to the pedestal head support by means of a coupling device, wherein the coupling device allows adjusting movements between the cylindrical main guide and the stabilizing guide to prevent the stabilizing guide from seizing, wherein the coupling device has a plurality of components, and the adjusting movements are made possible by pivotability of a first coupling component relative to a second coupling component about three different axes of rotation, and also due to displaceability of the first coupling component relative to the second coupling component along an axis of translation, and wherein the coupling device comprises a ball joint which enables adjusting movements.

* * * * *